United States Patent [19]

Tax et al.

[11] 4,028,792

[45] June 14, 1977

[54] METHOD OF ERECTING A TOWER CRANE FROM TWO GROUPS OF MODULAR TOWER SECTIONS DIFFERING IN CROSS SECTION

[75] Inventors: Hans Tax, Munich; Klaus Hösler, Eichenau, both of Germany

[73] Assignee: Hans Tax, Munich, Germany

[22] Filed: Apr. 29, 1976

[21] Appl. No.: 681,436

[30] Foreign Application Priority Data

May 9, 1975 Germany ..... 2520717

[52] U.S. Cl. ..... 29/431; 52/123; 52/127; 52/745; 254/89 H; 254/93 R

[51] Int. Cl.[2] ..... E04H 12/34

[58] Field of Search ..... 29/429, 431, 428, 155 R; 52/122, 123, 127, 111, 115, 741, 745; 254/89 H, 89 R, 93 R, 105, 139, 142

[56] References Cited

UNITED STATES PATENTS

| | | | |
|---|---|---|---|
| 2,676,388 | 4/1954 | Faure et al. | 29/431 |
| 2,857,994 | 10/1958 | Sheard | 29/428 X |
| 2,993,679 | 7/1961 | Morgan | 29/429 X |
| 3,494,593 | 2/1970 | Blagg | 254/139 |

*Primary Examiner*—Carl E. Hall
*Attorney, Agent, or Firm*—Hans Berman

[57] ABSTRACT

A tower crane is erected from a boom assembly, first and second tower sections of different cross section, and a base in a sequence of steps in which the boom assembly is mounted on a hollow climbing section dimensioned to be received in each of the larger second tower sections and defining a cavity dimensioned to receive each of the first tower sections. One of the latter is secured on a base in upright position, and the upright section is received in the cavity of the climbing section which is then raised relative to the first section and enveloped by one of the second sections. The enveloping section is secured to the base and the raised climbing section for supporting the climbing section whereupon the first tower section may be rleased from the base, raised, and secured to the second tower section. The climbing section may then be raised relative to the first tower section to permit the installation of another second section, and the procedure repeated, until all second or larger tower sections are superimposed on each other, the one first section being ultimately attached to the topmost second section. When the climbing section is raised relative to the attached first section, another first section may be superimposed on the one first section and the procedure repeated until the slimmer portion of the tower is assembled from superimposed first sections. Ultimately, the boom assembly is attached to the topmost first tower section, and the climbing section may be removed or stored for further use on the wider, lower tower portion.

10 Claims, 19 Drawing Figures

5
23
18
19
20
16
11
11
6
12
22
17
9
21
22
9

METHOD OF ERECTING A TOWER CRANE FROM TWO GROUPS OF MODULAR TOWER SECTIONS DIFFERING IN CROSS SECTION

This invention relates to tower cranes, and particularly to a method of erecting a tower crane from a boom assembly, two groups of modular tower sections differing in cross section, and a base.

Towers of construction cranes are commonly assembled from modular sections by installing the boom assembly on a section secured to the stationary crane base and raising the first section with the boom assembly by means of a lifting mechanism on the base to permit the insertion of an additional tower section. The procedure is repeated to raise the boom assembly to the required height. The method is not practical for tower cranes of great height.

It has been proposed in French Pat. No. 1,264,080 to increase the height of a tower assembled as described above by raising the lifting mechanism on the assembled tower sections to a position intermediate the base and the boom assembly, to envelope the lower sections with a shell of greater diameter to the height of the raised lifting mechanism, and thereafter to support the lifting mechanism on the shell while the entire sectional tower assembly is lifted a distance about equal to the height of the shell. The shell then constitutes the lower, wider portion of the crane tower. The method requires a lifting device of very great capacity, and the lifting of the long, sectional tower portion to its ultimate height may be hazardous.

In the French Pat. No. 1,496,402, it was proposed to erect first the entire, slim top portion of a tower crane having several longitudinal portions decreasing in cross section from the bottom toward the top, and to assemble the other portions between the raised lowermost section of the top portion and the base. The arrangement shares the disadvantages outlined above.

It is a primary object of this invention to provide a method of erecting a tower crane from sections of different cross section in which lifting equipment of modest capacity may be employed, and in which the widest, lowermost portion of the tower is completed before the sections of the slimmer upper portions are assembled, thereby making the crane tower stable in all intermediate stages of construction.

More specifically, the invention intends to provide a method of assembling a tower crane having a very broad lower tower portion for greatest stability, and a much slimmer top portion having a horizontal cross section of not more than one half of the corresponding section of the lower tower portion.

With these and other objects in view, the invention provides a method of erecting a tower crane from a boom assembly, a plurality of first or higher, modular tower sections, a plurality of second or lower, tubular, modular tower sections of larger cross section than the first sections, and a base. In the initial steps of the method, the boom assembly is mounted on a hollow climbing section dimensioned to be received in each of the second sections and defining a cavity dimensioned to receive each of the first sections. One of the first or upper sections is secured on the base in an upright position and is received in the cavity of the climbing section which is then raised relative to the upright first section by an interposed hoisting device. The raised climbing section is enveloped by one of the second or lower sections which is secured to the base and the raised climbing section for transmitting weight from the climbing section to the base, whereupon the first section may be released from the base. A hoisting device interposed between the climbing section and the released first section raises the first section, and the raised first section is secured to the second section. The climbing device is again released from the second section and raised relative to the raised and secured first section until the climbing section may be enveloped by another second section in a position in which the latter is upwardly offset from the one second section and may be secured to the same and to the climbing section.

After the afore-mentioned first tower section is released from the one second section, it is raised relative to the climbing section until it may be secured to the other second section. The climbing section is released next from the other second section and raised relative to the first section until a portion of the cavity in the climbing section intermediate the boom assembly and the first tower section is cleared.

Another first section is inserted into the cleared cavity portion and secured to the boom assembly and the one first section in weight transmitting relationship. This completes the erection of a tower crane whose tower has two, wide, lower, or second sections and two narrower, upper, or first sections alignedly superposed. The steps outlined above may be repeated as needed to increase the number of sections in each tower portion, and modified in an obvious manner to add further steps in order to erect a tower having modular sections of more than two different cross sections.

Other features of this invention, additional objects, and many of the attendant advantages will readily become apparent from the following detailed description of preferred embodiments when considered in connection with the appended drawing in which.

Figure 17:
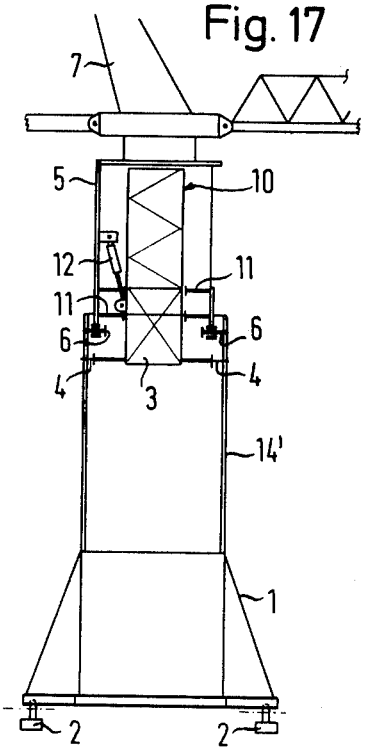
Figure 18:
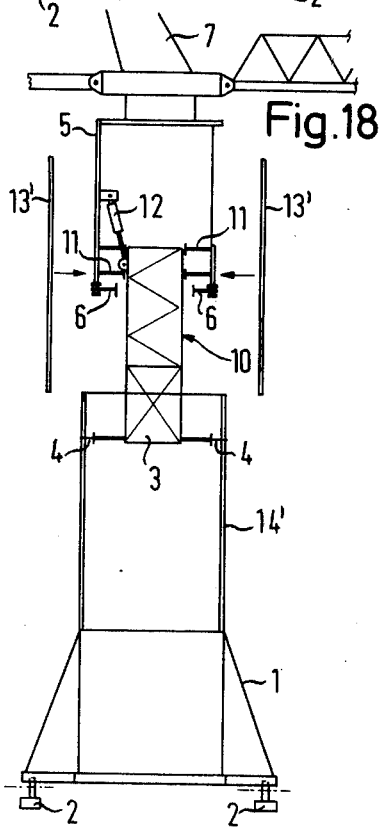
Figure 19:
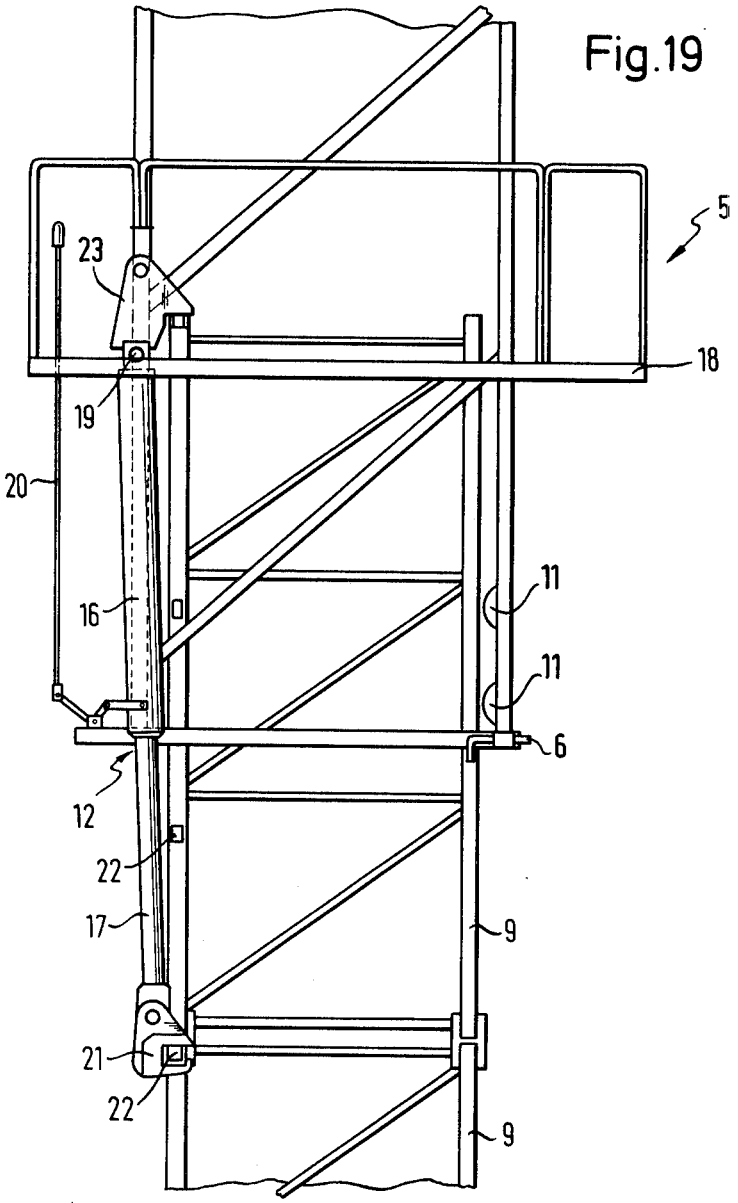

FIGS. 11 to 18 similarly illustrate the erection of a tower crane according to the invention in which the dimensional relationships of the tower sections differ from those seen in FIGS. 1 to 10; and FIG. 19 shows elements common to FIGS. 1 to 18 on a larger scale and in more detail.

Figure 1:
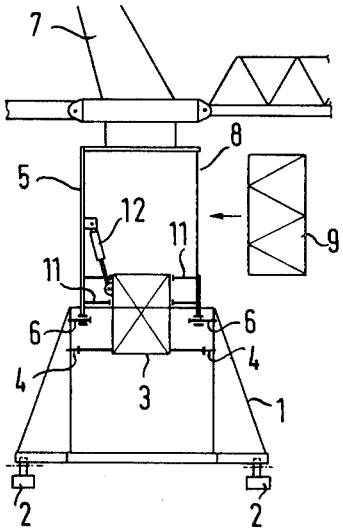
FIG. 1 illustrates the first stage in the erection of a tower crane according to the invention, the tower elements being shown in a simplified manner in fragmentary front elevation.

As is shown in FIG. 1, the tower proper of the crane to be erected rests on a plate steel base 1 having the general outline of the frustom of a pyramid and resting on rails 2. An intermediate tower section 3 is secured on the base 1 by means of retractable horizontal bars 4. A climbing section 5 is also secured on the base 1. As will be described in more detail with reference to FIG. 19, the climbing section is a lattice girder chamber whose cavity is open in a downward direction and toward the right, as viewed in FIG. 1. Retractable pins 6 secure the climbing section 5 to the base 1 in a position in which the intermediate section 3 projects into the cavity of the climbing section 5. The almost fully assembled boom portion 7 of the crane, conventional in itself and only partly shown in FIG. 1, is mounted atop the climbing section 5 so that the base plate of the boom assembly 7 upwardly bounds the cavity in the climbing section and its lateral opening 8. The opening is dimensioned to admit one of the first sections 9 which will ultimately form the top portion of the crane tower.

Engagement elements 11 of the climbing section 5 horizontally extend into guiding engagement with the intermediate tower section 3. The horizontal cross section of the intermediate and upper tower sections 3, 9 being the same square, the elements may cooperate in the illustrated manner with first or upper tower sections 9 to guide vertical relative movement of the climbing section 5 and the tower sections 3, 9. The difference in cross section between the section 5 and the sections 3, 9 has been exaggerated in FIGS. 1 to 10 for the convenience of pictorial representation and the elements 11 may be much shorter, relative to other dimensions, than is shown in FIG. 1, and their function actually may be assumed by direct engagement of lattice elements of the sections 3, 5, 9 for guiding relative vertical movement of the same, no other guidance being necessary, as will presently become apparent.

A double acting, hydraulic jack 12 is hingedly attached to the climbing section 5 and engages the intermediate tower section 3 in the condition of the crane illustrated in FIG. 1.

Figure 2:
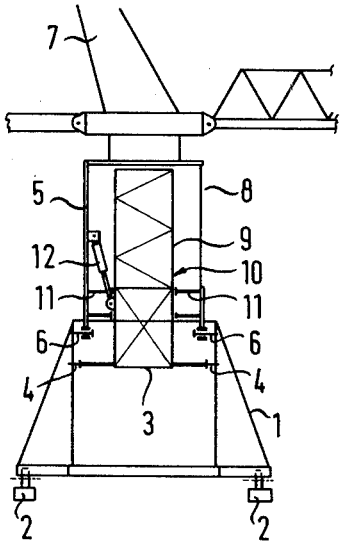
FIGS. 2 to 10 show further stages in the erection of the same tower crane leading to the fully assembled crane.

After the first or upper tower section 9 has been inserted into the cavity of the climbing section 5 as indicated by an arrow in FIG. 1, it is alignedly bolted to the intermediate section 3 to constitute with the same a guide unit 10 until the crane is again to be dismantled, the resulting structure being shown in FIG. 2.

Figure 3:
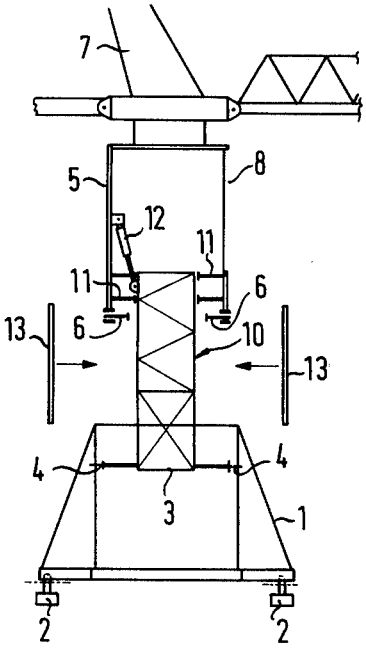

By expanding the jack 12 and by shifting the point of engagement of the jack upwards along the guide unit 10, the climbing section 5, released by the pins 6 from the base 1, is raised or climbs upward into the position seen in FIG. 3 in which the section 5 is vertically secured on the guide unit 10 by the jack 12, and a gap opens vertically between the climbing section 5 and the base 1. The gap is closed by four lattice panels 13 of which only two are seen in FIG. 3 in order not to crowd the drawing. The four panels, when bolted together along vertical edges, constitute a lower or second, tubular tower section 14 seen in FIG. 4 to rest on the base 1 and to envelop the lower end portion of the climbing section 5 so that the latter may be secured vertically by inserting the pins 6 into aligned openings of the section 14.

Figure 4:
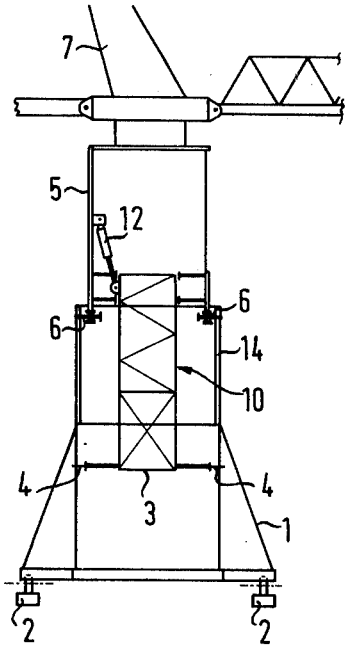
Figure 5:
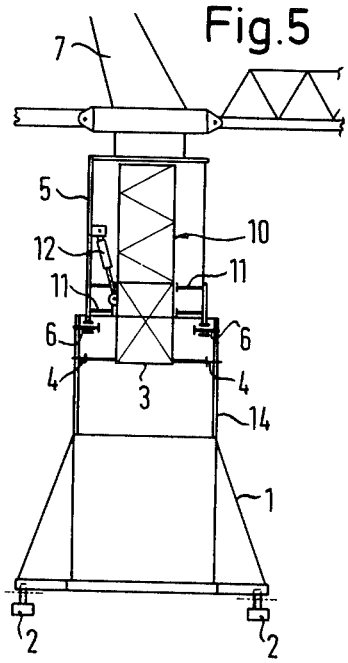
Figure 7:
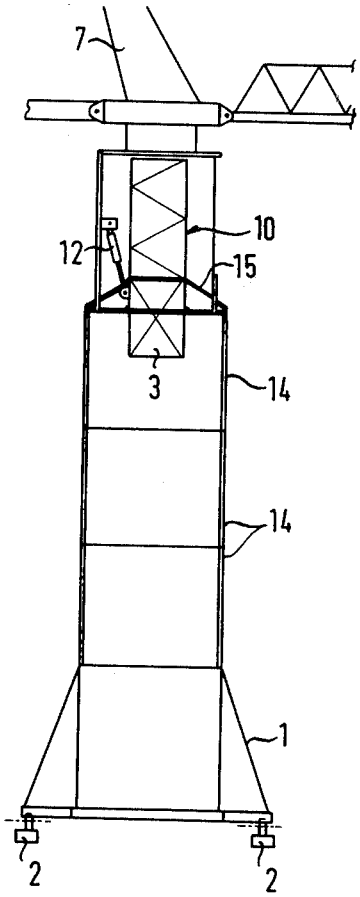
Figure 6:
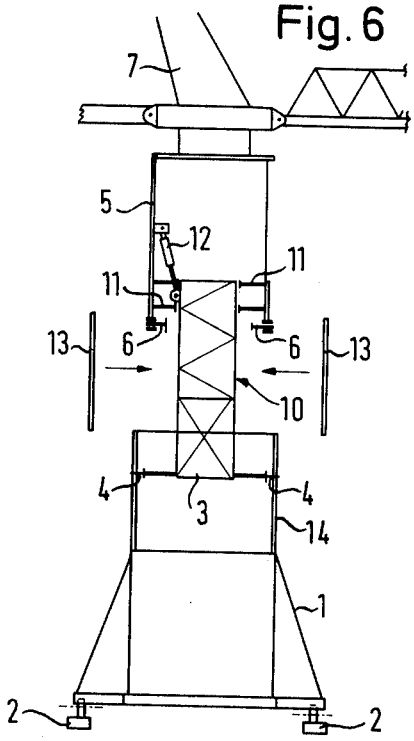
Figure 8:
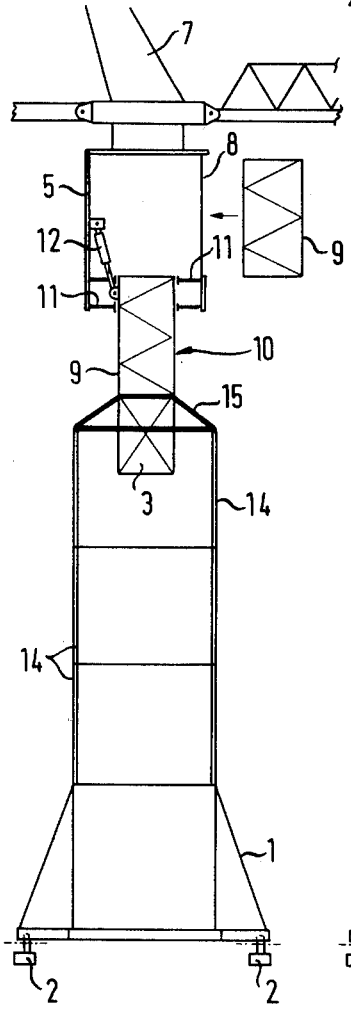
Figure 9:
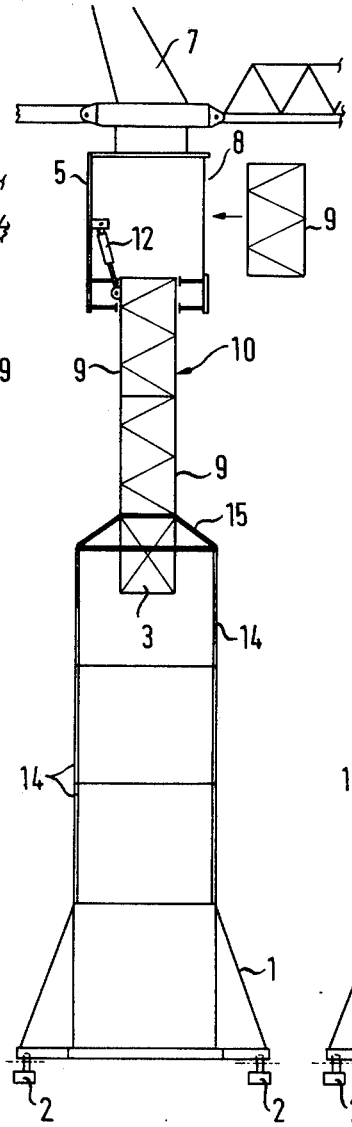

While the piston rod of the jack 12 is stressed in compression while raising the climbing section 5 from the position of FIGS. 1 and 2 into that of FIGS. 3 and 4, it is next stressed in tension to lift the guide unit 10 from the base 1 to the top limit of the cavity in the climbing unit 5. The bars 4, released from the base 1 prior to the lifting of the guide unit 10, are inserted in apertures of the second tower section 14 vertically to secure the guide unit 10.

The climbing section 5 may next climb to the top of the guide unit 10, as described above, until the position of FIG. 6 is reached in which a gap vertically opens between the climbing section 5 and the one second tower section previously installed so that another set of panels 13 may be installed, as indicated by arrows and described above. The procedures described with reference to FIGS. 3 to 6 are repeated as often as is needed to assemble a lower tower portion of desired height, the partly assembled tower crane seen in FIG. 7 having three lower or second sections 14 alignedly superimposed on each other.

The slimmer top portion of the tower crane is then assembled on the guide unit 10 whose intermediate section 3 is bolted to the topmost second tower section 14 and further fastened by means of struts 15. The climbing section 5 is raised along a previously installed first or upper tower section 9 until a portion of its cavity intermediate the boom assembly 7 and the last installed first tower section 9 is cleared sufficiently to receive another first section 9 through the opening 8. The newly inserted section 9 is attached to the subjacent section 9, whereupon the section 5 resumes its climb. This sequence of steps is repeated until the last upper tower section 9 is installed. The base plate of the boom assembly is fixedly attached to the uppermost tower section 9, and the climbing section 5 becomes superfluous, having accomplished its function. It may be left in its high position shown in FIG. 9 if the crane is to be dismantled in a relatively short time. It may be lowered until it rests on the topmost lower tower section 14 as indicated in broken lines in FIG. 10, or it may be disassembled and stored elsewhere until needed again.

The procedures outlined above with reference to FIGS. 1 to 10 were described with reference to lower tower sections 14 and upper tower sections 9 which are of equal height. The procedure requires minor modifications if the two groups of tower sections differ not only in cross section, but also in vertical length. A modified procedure suitable for lower or second tower sections 14′ which are taller than the upper, first sections 9 and the climbing section 5 is shown in FIGS. 11 to 18.

Figure 11:
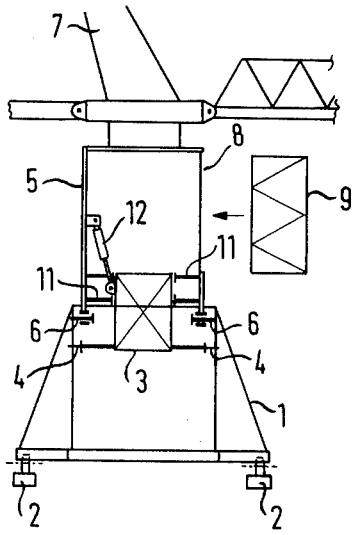
Figure 12:
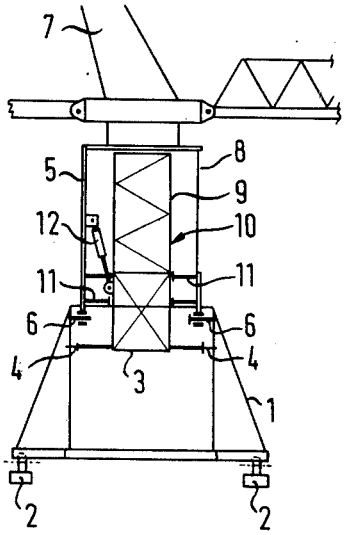
Figure 13:
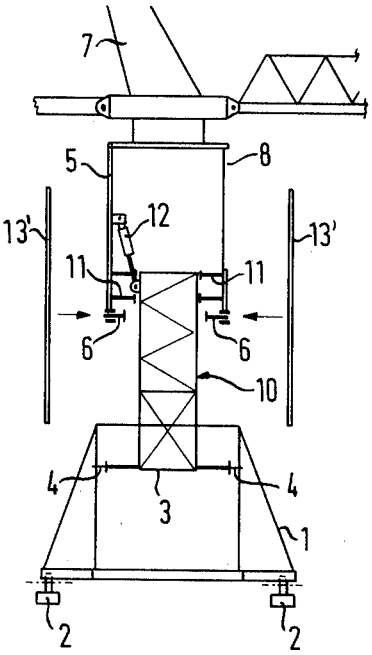
Figure 14:
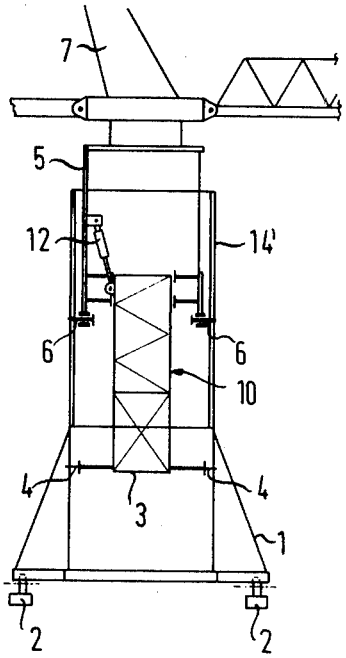
Figure 15:
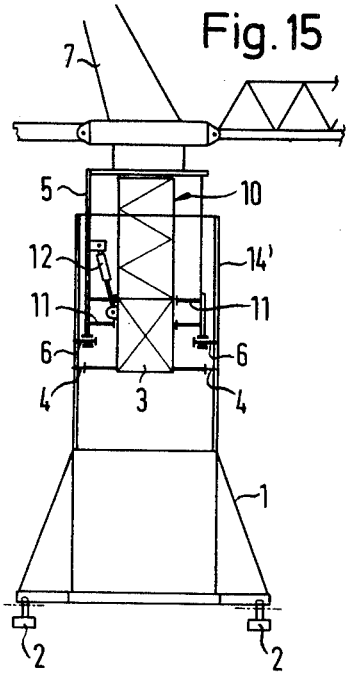
Figure 16:
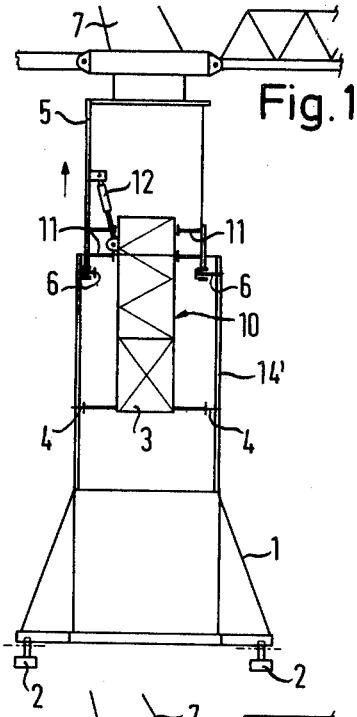

The initial steps illustrated in FIGS. 11 and 12 are the same as described above with reference to FIGS. 1 and 2, but, as is shown in FIG. 13, the gap opened by the climbing section 5 being raised along the guide unit 10 is vertically much narrower than the height of the girder panels 13′ of which four are bolted together to form a second or lower tower section 14′ enveloping the climbing section 5 over much more than one half of its height (FIG. 14).

When the guide unit 10 is next raised to its top position in the cavity of the climbing unit (FIG. 15), and the climbing section 5 thereafter climbs to its topmost position of the guide unit 10 (FIG. 16), no further gap is formed below the climbing unit 5, but the position reached corresponds to that shown in FIG. 4. Another raising of the guide unit into the position of FIG. 17 and an additional raising of the climbing unit 5 is needed for reaching the position of FIG. 18 in which yet another set of panels 13′ may be installed.

The assembly of the lower tower portion essentially consists of repetitions of the steps illustrated in FIGS. 17 and 18, and may be followed by assembly steps not significantly different from those described above with reference to FIGS. 8 to 10, for installing the upper tower portion.

The climbing unit 5 common to the two aforedescribed embodiments of the invention is partly shown in FIG. 19. It includes an operator's platform 18 on which the control valve actuators for the jack 12 may be mounted, and from which the pressure lines for the necessary hydraulic fluid would normally depend in a manner conventional in itself and not illustrated.

The cylinder 16 of the double-acting jack 12 is suspended from the platform 18 by means of a pivot pin 19. An arm 20 attached to the end of the cylinder 16 remote from the pivot 19 may be swung manually by the operator to engage a U-shaped jaw or grip 21 at the free outer end of the piston rod 17 projecting from the cylinder 16 with engagement pins 22 spaced along each first or upper tower section 9. Hooks 23, of which only one is seen in FIG. 19, permit the climbing section to be secured on a tower section 9 while the jaw 21 is disengaged.

Figure 10:
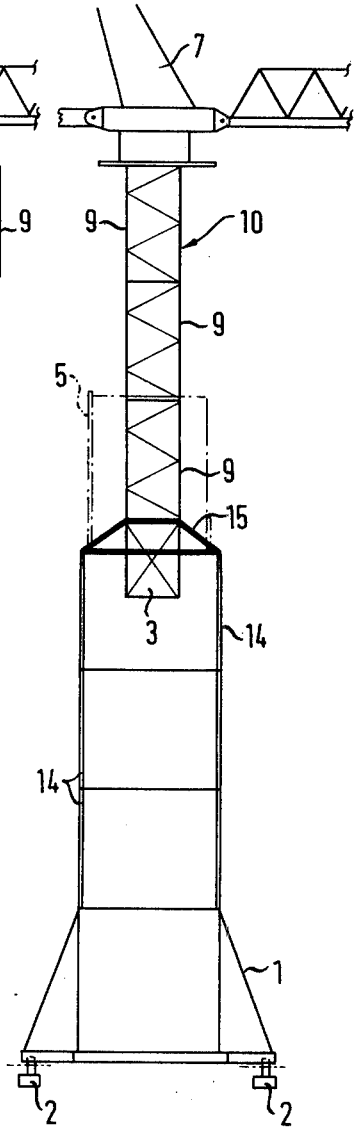

As is not explicitly shown in the drawing, the boom assembly 7 may be used for raising the upper tower sections 9 to the level of the aperture 8 in the climbing unit 5, and for raising the panels 13, 13' as needed. The jack 12 and hooks 23 may be used in an obvious manner for gradually lowering the climbing section 5 from the position of FIG. 9 to the position which is indicated in FIG. 10 by broken lines since it may be transitory.

In actual embodiments of the illustrated invention, the lower tower sections had cross sections of 4 meters square or more, and the upper sections typically of 2.5 meters square. The climbing sections were guided exclusively on the upper or first sections during erection of the entire crane tower, having cavities dimensioned to receive the upper sections with little horizontal clearance. The large difference in cross sectional dimensions between the upper and lower tower sections did not affect the simplicity and reliability of the erecting procedure. The same climbing section could be used on different towers varying in the dimensions of the lower sections, but having fairly uniform upper sections.

The same climbing section could be used in erecting a tower having vertical portions of three or more different cross sections, as long as the top sections were dimensioned to be received in the cavity of the climbing section, and the larger sections were tubular and capable of receiving the climbing section therein.

Other modifications of the invention will readily suggest themselves to those skilled in the art on the basis of the above teachings. It should be understood, therefore, that the foregoing disclosure relates only to preferred embodiments, and that it is intended to cover all changes and modifications of the examples of the invention herein chosen for the purpose of the disclosure which do not constitute departures from the spirit and scope of the invention set forth in the appended claims.

What is claimed is:

1. A method of erecting a tower crane from a boom assembly, a plurality of first modular tower sections, a plurality of second, tubular, modular tower sections of larger cross section than said first sections, and a base, which comprises the steps of:

a. mounting said boom assembly on a hollow climbing section dimensioned to be received in each of said second sections and defining a cavity dimensioned to receive each of said first sections, said cavity being open in at least one direction;

b. securing one of said first sections on said base in an upright position, and receiving the upright section in said cavity;

c. raising said climbing section relative to said one first section by interposed hoisting means;

d. partly enveloping the raised climbing section by one of said second sections;

e. securing said one second section to said base and to said raised climbing section for transmitting weight therebetween, and releasing said one first section from said base;

f. raising the released first section relative to said climbing section by interposed hoisting means and securing the raised first section to the secured second section;

g. releasing said climbing section from said one second section and raising said climbing section by interposed hoisting means relative to the raised first section;

h. thereafter enveloping said climbing section by another second section and securing said another second section to said one second section in vertically offset relationships and to said climbing section;

i. releasing said one first section from said one second section, raising the released first section relative to said climbing section by interposed hoisting means, and securing the raised first section to said another second section;

j. releasing said climbing section from said another second section and raising the released climbing section relative to said first section by interposed hoisting means until a portion of said cavity intermediate said boom assembly and said one first section is cleared;

k. inserting another first section in said portion of said cavity, and securing the inserted other first section to said boom assembly and to said one first section in weight transmitting relationship.

2. A method as set forth in claim 1, wherein the same, double-acting hoisting means are interposed between said one first section and said climbing section for each of said raising of the one first section relative to said climbing section and for each of said raising of the climbing section relative to said one first section.

3. A method as set forth in claim 2, wherein said double-acting hoisting means are permanently secured to said climbing section.

4. A method as set forth in claim 3, wherein said double-acting hoisting means include a cylinder member and a piston rod member moving into and out of said cylinder member during said raising, one of said members being fastened to said climbing section, the other member carrying a grip and engaging one of a plurality of portions of said one first section during each raising.

5. A method as set forth in claim 4, wherein said piston rod member is stressed in compression during said raising of said climbing section, and said piston rod member is stressed in tension during said raising of said one first section.

6. A method as set forth in claim 4, wherein said grip is manually engaged with and disengaged from respective portions of said one first section before and after at least one of said raisings.

7. A method as set forth in claim 1, wherein said climbing section is vertically guided during each of said raisings thereof by movable engagement with said one first section.

8. A method as set forth in claim 1, wherein said cavity is open in a horizontal direction, and said other first section is inserted in said portion of said cavity by movement in a horizontal direction.

9. A method as set forth in claim 1 further comprising the step of releasing said climbing section from said boom section after said securing of said other first section.

10. A method as set forth in claim 9, further comprising the step of lowering the released climbing section and securing the lowered climbing section to one of said second sections in weight transmitting relationship.

* * * * *